US005135294A

United States Patent [19]

Ohshima et al.

[11] Patent Number: 5,135,294

[45] Date of Patent: Aug. 4, 1992

[54] MECHANISM FOR CONTROLLING THE TRAVEL OF A STRUCTURAL MEMBER

[75] Inventors: Kazuyoshi Ohshima; Seiichiro Tamura, both of Tokyo, Japan

[73] Assignee: Sugatsune Industrial Co., Ltd., Tokyo, Japan

[21] Appl. No.: 704,412

[22] Filed: May 23, 1991

[30] Foreign Application Priority Data

May 23, 1990 [JP] Japan ..... 2-133139

[51] Int. Cl.[5] ..... A47B 33/00

[52] U.S. Cl. ..... 312/319.1; 312/334.46

[58] Field of Search ..... 312/319, 333, 348, 344.1; 384/19, 20, 21

[56] References Cited

U.S. PATENT DOCUMENTS 5,004,306 4/1991 Oshida ..... 312/319
5,015,048 5/1991 Brunnert ..... 312/319
5,056,879 10/1991 Rock et al. ..... 312/319

*Primary Examiner*—Joseph Falk
*Attorney, Agent, or Firm*—Fleit, Jacobson, Cohn, Price, Holman & Stern

[57] ABSTRACT

According to the invention, there is provided an ingenuously contrived mechanism for controlling the travel of a movable structural member along rails comprising a pair of traveler devices removably engaged with the respective rails. With such devices, the movable member can be easily separated from the fixed member that houses it. Such a mechanism is particularly suited for a cabinet drawer.

3 Claims, 7 Drawing Sheets

MECHANISM FOR CONTROLLING THE TRAVEL OF A STRUCTURAL MEMBER

BACKGROUND OF THE INVENTION

1. Technical Field

This invention relates to a mechanism for controlling the travel of a structural member to be suitably used for a drawer.

2. Background Art

A known conventional drawer cabinet comprises a cabinet frame having one or more compartments, a pair of fixed rails arranged in each compartment, a pair of sliding rails for slidingly traveling on a corresponding pair of fixed rails and a drawer arranged on each pair of sliding rails as well as a pair of coil springs arranged for each pair of fixed rails to impart a force to the corresponding pair of sliding rails to regain their original position and a lock means for locking a corresponding drawer against the resilient force of the corresponding coil springs in such a manner that the drawer may be automatically returned to the compartment by means of said springs once the lock means is released. (See Japanese Utility Design Disclosures Jikkai Shou No. 64-43743 and No. 64-43744.)

With a known drawer cabinet having a configuration as described above, an end of each spring is securely fitted to the cabinet frame by winding it around a hook arranged on the cabinet frame and the other end is fitted to a corresponding drawer so that the spring may be resiliently expanded as the drawer is pulled away from the compartment.

With such an arrangement, the drawer cannot be completely removed from the cabinet frame, making any hauling movement of a loaded and stuffed cabinet a very cumbersome operation. Moreover, the operation of assembling the cabinet requires time and labor as the fixed and sliding rails need to be fitted to the compartment and drawer respectively with the springs bound to the fixed and sliding rails.

In view of these and other problems of existing drawer cabinets, it is therefore the object of the present invention to solve these problems by providing a mechanism for controlling the travel of a movable member of a drawer cabinet that allows the movable member to freely travel within a predetermined range of movement relative to a matching fixed member by means of a clutch and, whenever necessary, to be completely separated from the fixed member and readily put back to its proper position.

SUMMARY OF THE INVENTION

According to the invention, the above object of the invention is achieved by providing a mechanism for controlling the travel of a movable structural member along rails comprising a fixed member provided with a pair of fixed rails and a pair of sliding rails engaged with the respective fixed rails and a movable member arranged on said sliding rails, wherein it further comprises a pair of traveler devices removably engaged with the respective fixed rails, a pair of spring means for pulling the respective traveler devices in a given direction, and a pair of clutch means for holding the respective traveler devices at a desired position after moving them in the other direction, said traveler devices being provided with a longitudinally swingable catch means forwardly urged by a spring for engaging the traveler device with or disengaging it out of the corresponding sliding rail and switching the operation of the clutch.

The pulling force of the spring means is applied to the traveler devices along the fixed rails in such a manner that said traveler devices are halted at and held to an end of the respective fixed rails.

Under this condition, the traveler devices are coupled to the respective sliding rails of the movable member by the catch means.

Now, if an external force is applied to the movable member in a first direction (to pull out the movable member), the traveler devices are moved with the movable member in the same direction along the fixed rails against the pulling force of said spring means until they reach a predetermined position, where the catches engaged with the respective sliding rails are rotated in a direction by the sliding rails so that the catches push and activate the respective clutches, which by turn stop and hold the respective traveler devices, releasing the engagement between the sliding rails and the catches. Then, only the movable member can keep on moving in the same direction until the sliding rails are disengaged from the respective fixed rails and the movable member is separated from the fixed member.

The separated movable member can be put back into the fixed member by bringing the sliding rails into engagement with the respective fixed rails and then moving the movable member in the opposite direction until the sliding rails come to be engaged with the respective catches, which are by turn rotated in the opposite direction to secure the engagement with the sliding rails and at the same time release the clutch means out of the pushed condition and the traveler devices out of the halted state.

Then, the traveler devices are pulled by said spring means and automatically move with the movable member in the opposite or second direction until the latter is returned to the initial position.

In other words, the movable member automatically starts running along the fixed rails the instant the traveler devices are released from the halted condition all the way to the end of its stroke, that can be defined by arbitrarily selecting the position of the clutches that hold and release the respective traveler devices.

Now the present invention will be described in greater detail by referring to the accompanying drawings that illustrate a preferred embodiment of the invention.

DETAILED DESCRIPTION OF THE INVENTION

Figure 1:
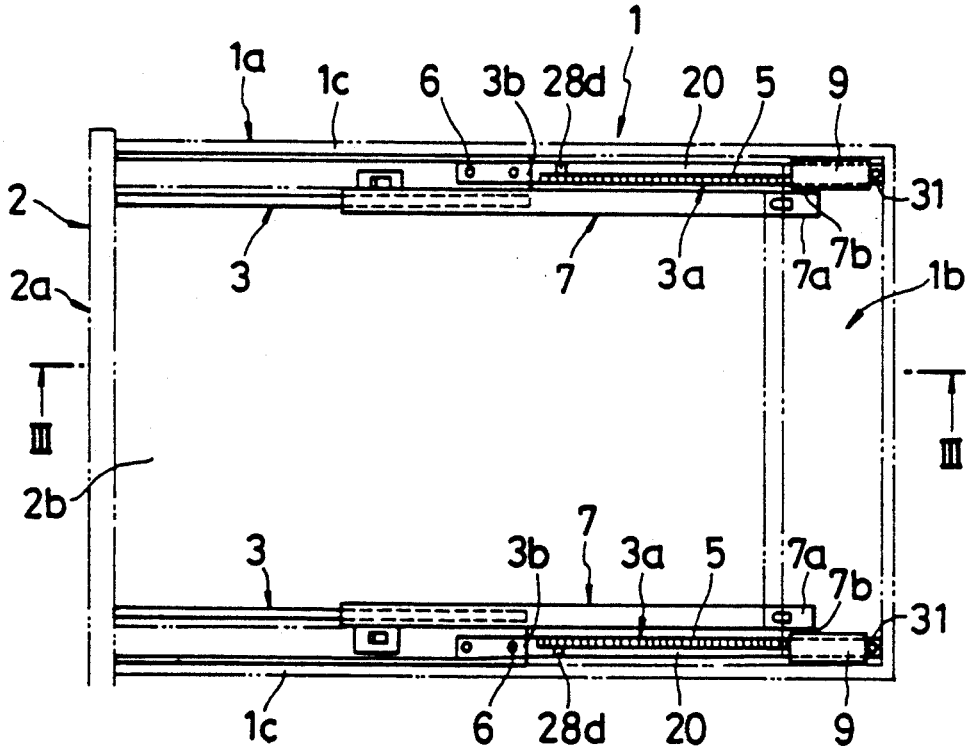
FIG. 1 a plan view of a preferred embodiment of the invention.
Figure 2:
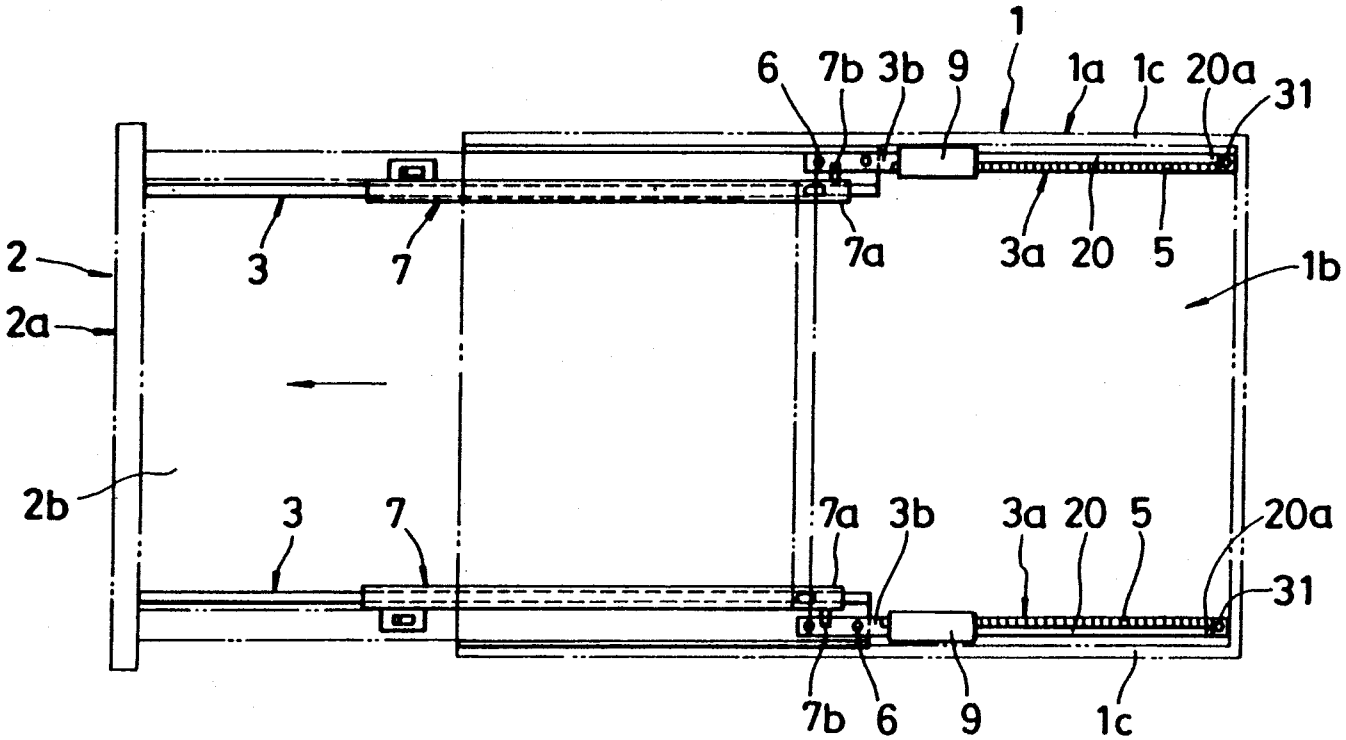
FIG. 2 a plan view similar to FIG. 1 but showing the movable member of the embodiment located midway along its stroke.
Figure 3:
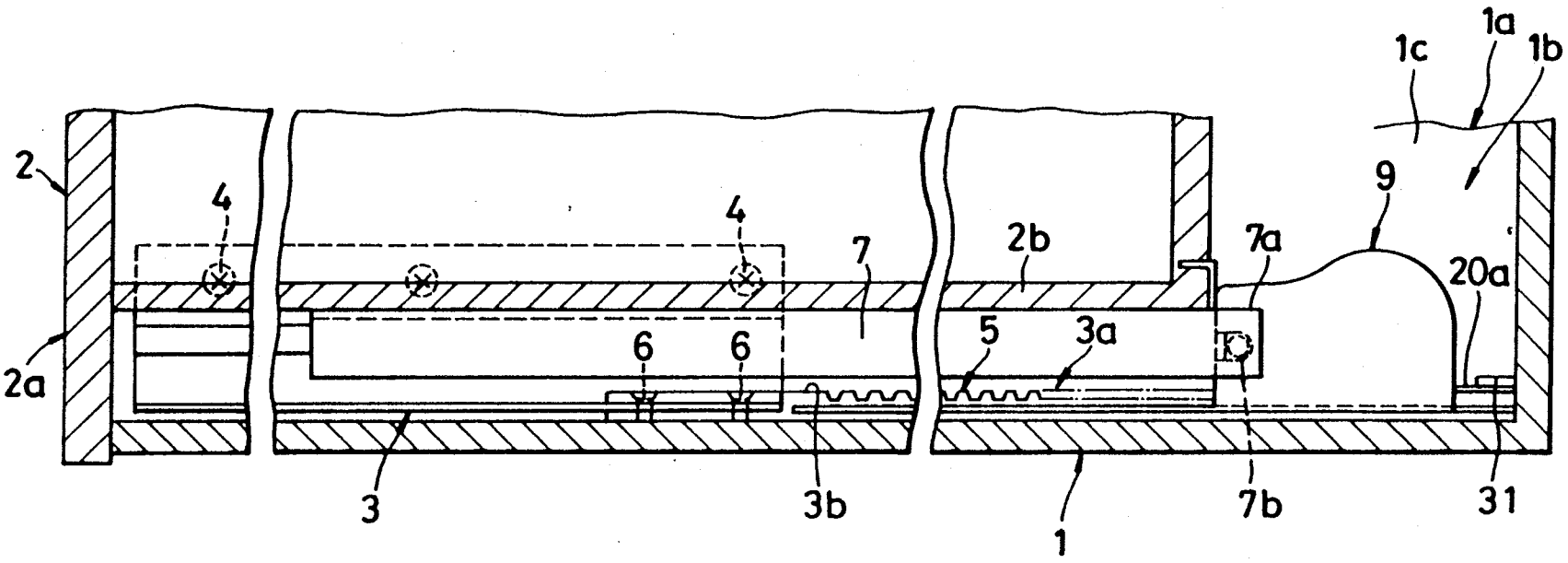
FIG. 3 is an enlarged sectional view of the embodiment along line III—III line of FIG. 1.

In FIGS. 1 through 3, reference numeral 1 generally denotes a fixed member realized in the form of a rectangular cabinet frame 1*a* comprising a number of compartments 1*b*, of which only one is shown, and left and right side panels 1*c*, 1*c*. A pair of longitudinal (running from left to right in FIGS. 1 through 3) fixed rails 3, 3 are arranged horizontally and in parallel relative to each other in the compartment 1*b* on the respective inner surfaces of the side panels 1*c*, 1*c* and rigidly secured thereto by means of screws 4.

Said pair of fixed rails 3, 3 are approximately as long as a half of the length of the compartment 1*b* and arranged within its front half area. A pair of auxiliary fixed rails 3*a*, 3*a* provided with a rack 5 on the inner half area of the upper surface extend rearward from the front ends of the respective fixed rails 3, 3 also horizontally and in parallel relative to each other but out of alignment from the respective fixed rails 33 and rigidly secured to the respective inner surfaces of the side panels 1*c*, 1*c* within the rear half area of the compartment 1*b*.

Reference numeral 2 denotes a movable member realized in the form of a drawer 2*a* housed in the compartment 1*b* and provided with a pair of longitudinal sliding rails 7, 7 arranged along the lateral edges of the lower surface of its bottom panel 2*b* in such a manner that they are engaged with the respective fixed rails 3, 3.

Thus, said drawer 2*a* is movably housed in said compartment lb by means of said fixed rails 3, 3 and said sliding rails 7, 7.

Figure 6:
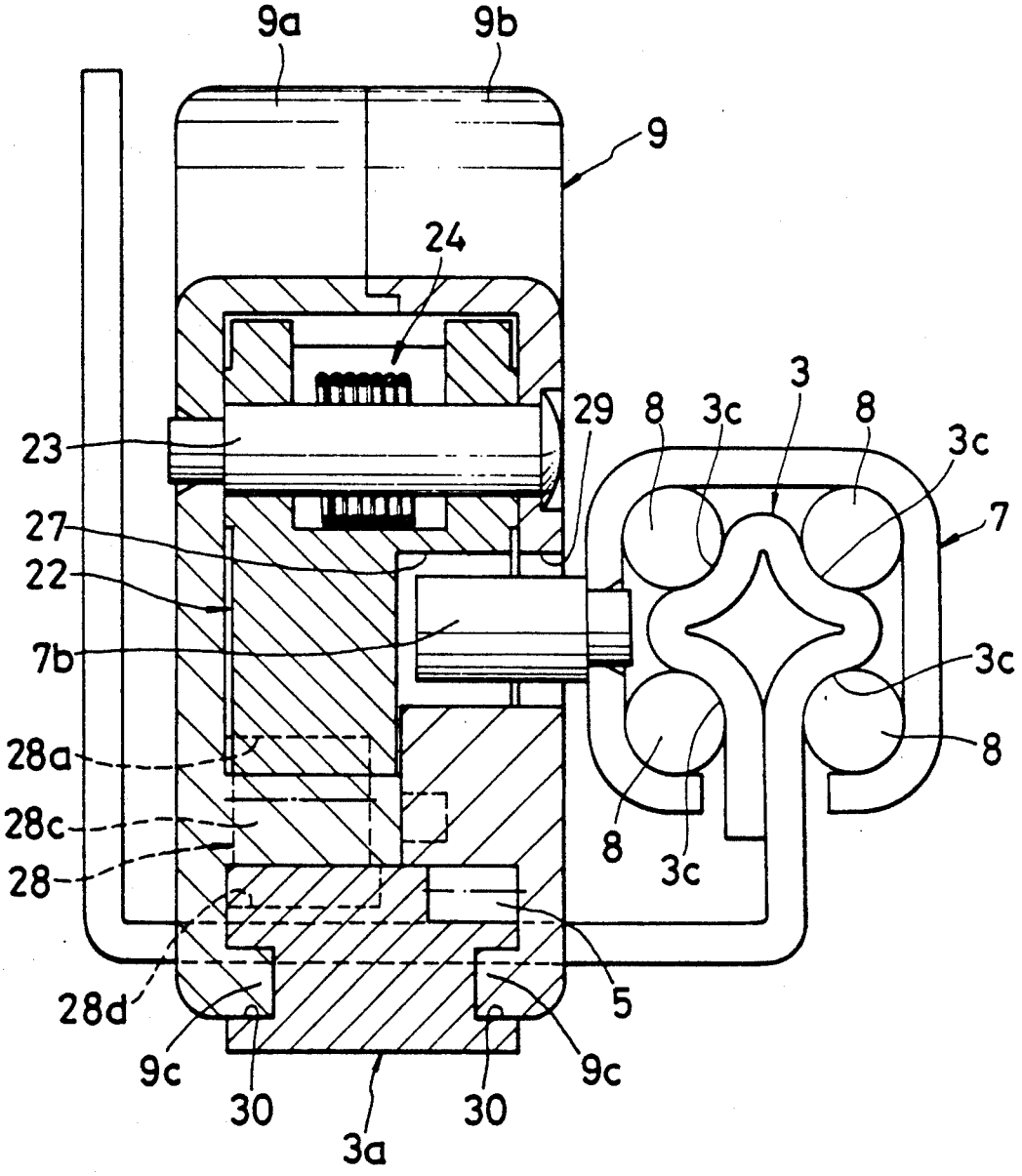
FIG. 6 is a sectional front view of the traveler device of FIG. 4 shown in association with the related fixed and sliding rails.

Each of the sliding rails 7, 7 may be typically configured and arranged along and within the corresponding fixed rail as illustrated in FIG. 6. Each rail 3 is provided with four round grooves 3*c* and an appropriate number of steel balls 8 are arranged in each groove at a given pitch so that the sliding rail 7 may smoothly move along the fixed rail 3. Alternatively, the fixed rail 3 and the sliding rail 7 may be so configured that they have a pair of matching round conduits laterally projecting from the upper and lower ends to form a pair of longitudinal and cylindrical spaces arranged at the upper and lower ends of the rails for containing a number of steel balls at a given pitch so that the sliding rail may freely slide along the fixed rail. With such an arrangement, the net effect will be also a sliding rail 7 that can freely move along a fixed rail 3.

The rear portions 7*a*, 7*a* of the sliding rails 7, 7 extend from the rear end of the drawer 2*a* and carry respective pins 7*b*, 7*b* projecting horizontally and outwardly toward the side panels 1*c*, 1*c* of the compartment 1*b* so that they may removably come to engagement with respective catches, which will be described later.

Said pair of auxiliary fixed rails 3*a*, 3*a* are put to engagement with respective traveler devices 9, 9 in a manner as described below so that the latter may slidingly move along the auxiliary fixed rails.

Figure 4:
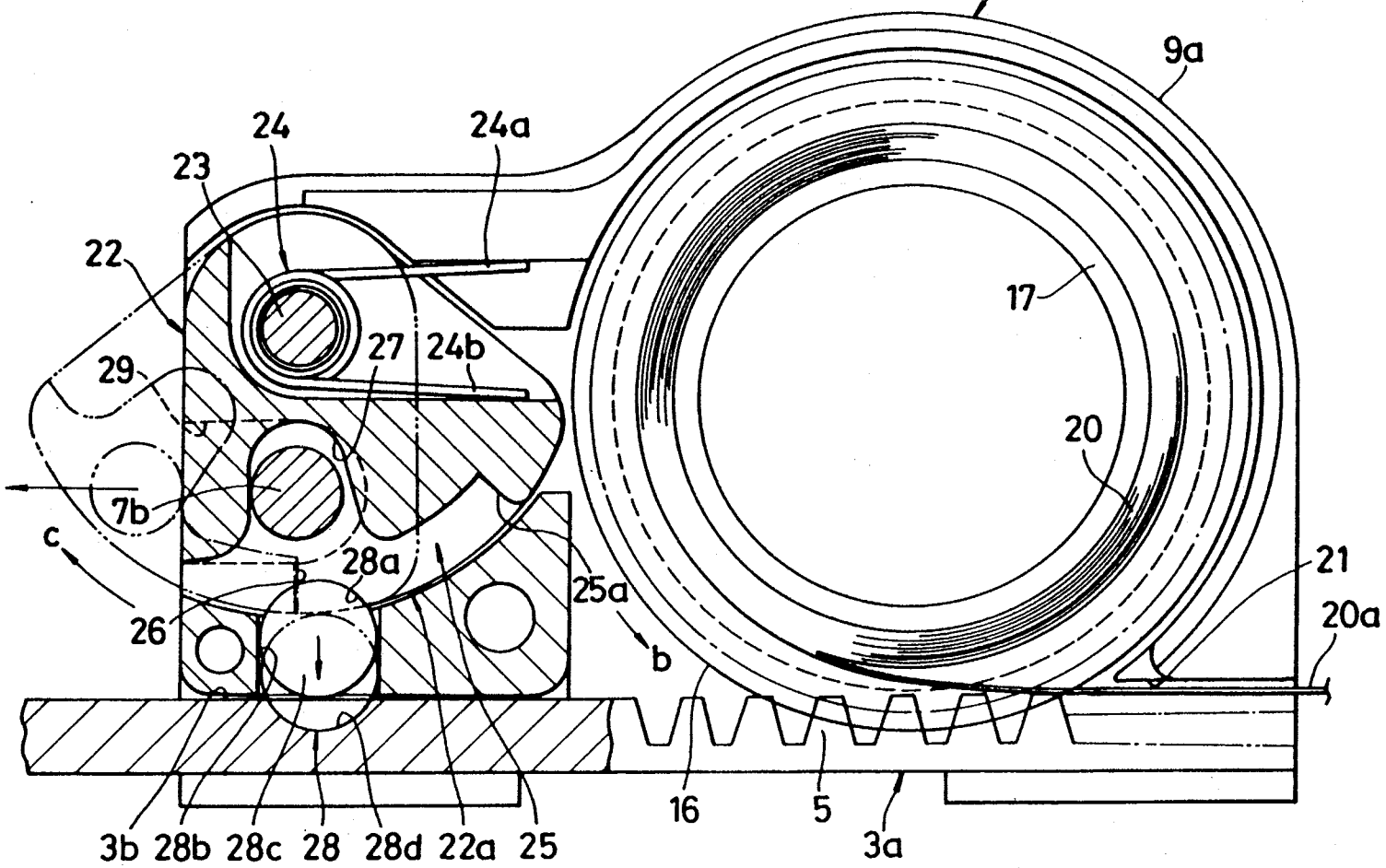
FIG. 4 is an enlarged sectional side view of one of the traveler devices of the embodiment of FIG. 1.
Figure 5:
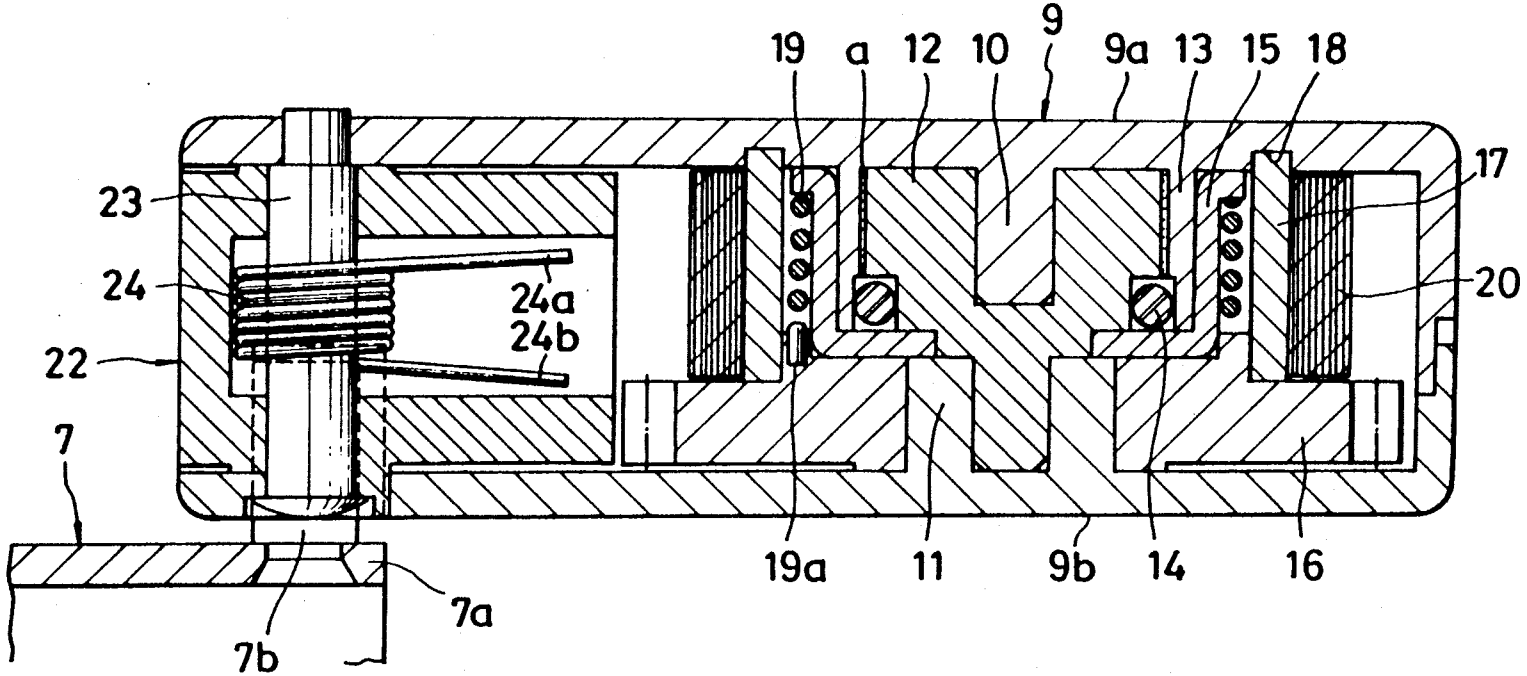
FIG. 5 is an enlarged section plan view of the traveler device of FIG. 4.

Referring to FIGS. 4 through 6, a traveler device 9 comprises a main body 9*a*, a lid 9*b* fitted thereto, a shaft 10, a bearing 11 and a rotary cylinder 12 freely rotatable around said shaft 10, the shaft 10, the bearing 11 and the rotary cylinder 12 being contained within the assembled main body 9*a* and lid 9*b*, and the space between said rotary cylinder 12 and a cylindrical portion 13 of said main body 9*a* surrounding said rotary cylinder 12 is filled with a highly viscous fluid a and airtightly sealed by an O-ring 14.

A movable cylinder 15 is arranged around said cylindrical portion 13 in such a manner that it may rotate integrally with said rotary cylinder 12 and the bearing 11 of said lid 9*b* rotatably carries around its periphery a pinion 16 which is engaged with said rack 5.

A cylindrical member 17 is integrally fitted to a lateral side of said pinion 16 so that it rotates with said pinion 16 when an end of said cylindrical member 17 is radially slidably engaged with an annular groove 18 arranged on the inner surface of said main body 9*a*, said cylindrical member 17 being coaxial with said movable cylinder 15 with an appropriate annular space provided between the outer periphery of said movable cylinder 15 and the inner periphery of said cylindrical member 17.

A spring one-way clutch 19 is arranged within said annular space and on the outer peripheral surface of said movable cylinder 15 while a wide and constant-load coil spring 20 is wound around the outer periphery surface of said cylindrical member 17 in such a manner that the coil spring 20 is pulled backward out of the body-lid assembly through an opening 21 arranged at the bottom of the assembly as seen in FIG. 4 and its exposed rear end 20*a* is rigidly fitted to the rear end of the auxiliary fixed rail 3*a* along with an abutment 31 by means a screw.

An end 19*a* of said spring one-way clutch 19 is hooked and anchored to said pinion 16 while the other end is kept free so that the pinion 16 is rotated and moved in the direction as indicated by arrow b in FIG. 4 on the rack 5 when the traveler device 9 is pulled away from the compartment with the drawer 2, making the spring one-way clutch 19 to expand its diameter and to become loose relative to the movable cylinder 15.

When the traveler device 9 is pulled rightward in FIG. 1 with the drawer 2*a* by the pulling force of said coil spring 20 and consequently the pinion 16 is rotated and moved on the rack 5 in the direction opposite to that of arrow b in FIG. 4, the spring one-way clutch 19 is tightly wound around the movable cylinder 15 by said pinion 16 so that the rotary force of the pinion 16 is transmitted to the movable cylinder 15 and the rotary cylinder 12 to generate in the highly viscous fluid a a viscous shearing drag, which acts as a braking force applied to the traveler device 9 when it is returned to compartment 1*b*.

A catch 22 is pivotally arranged around a horizontal shaft 23 in the front area of the inside of the assembled main body 9*a* and lid 9*b* so that it may longitudinally swing back and forth around the shaft 23 and is forwardly urged to rotate in the sense as indicated by arrow C in FIG. 4 by means of a spiral spring 24 arranged around said horizontal shaft 23 with an end secured to the main body 9*a* and the other end hooked to said catch 22.

Figure 7:
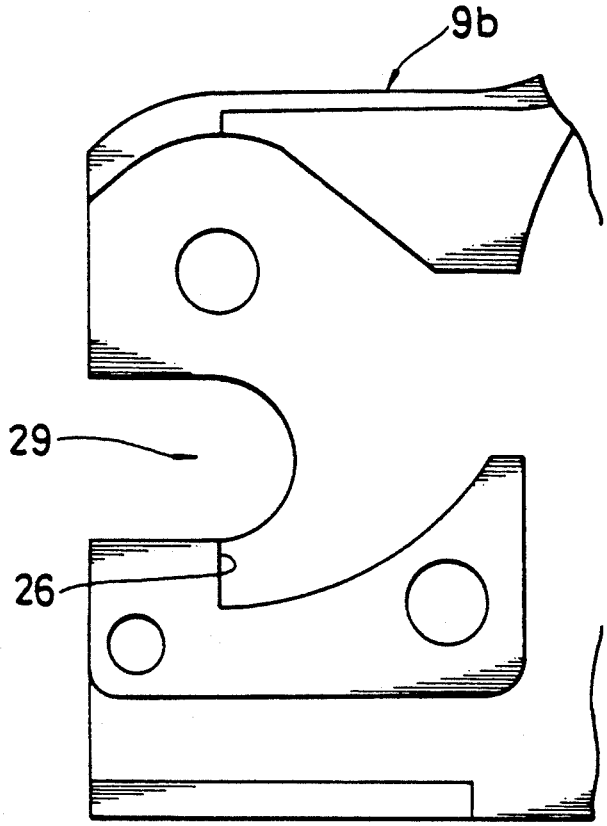
FIG. 7 is a schematic view showing the inside of the traveler device of FIG. 4.
Figure 8:
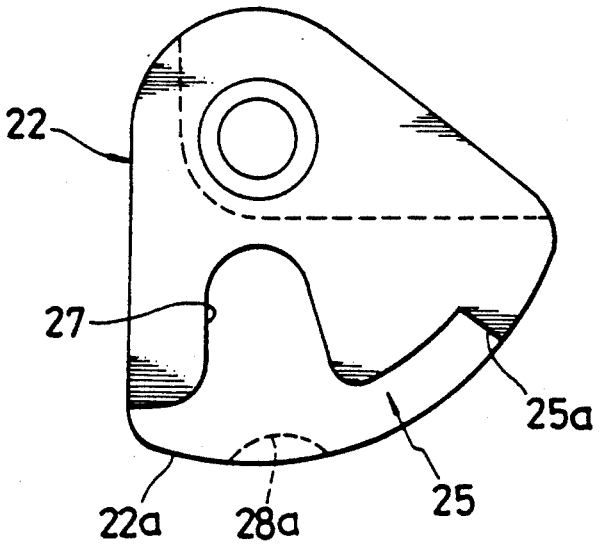
FIG. 8 is a schematic side view of one of the catches of the embodiment.

As seen from FIGS. 4 and 8, said catch 22 has a substantially sectorial lateral view and pivotally supported at its center by said horizontal shaft 23. Said catch 22 is provided on one of its lateral sides with a circumferential recess 25 having at its rear end an end wall 25*a* that acts as a stopper to abut against a stepped section 26 arranged on the inner surface of the lid 9*b* as shown in FIGS. 4 and 7 and nearer to its front end a radial extension 27 that may removably be engaged with said pin 7*b*.

Said catch 22 is also provided with a bore 28a on its arc-shaped bottom and near its front end to act as a component of a clutch 28, which will be described later.

With such an arrangement, the catch 22 is urged by the spring 24 to rotate forward to a position as indicated by a broken line in FIG. 4, where it is held as said stepped section 26 is interlocked with the stopper 25a. As the drawer 2a is pushed back into the compartment 1b under this condition, the pin 7b of the sliding rail 7 comes to be engaged with said radial extension 27 of the recess 25. If, under this condition, the drawer 2a is pushed back further, said pin 7b pushes a lateral wall of said radial extension 27 of the recess 25 to rotate said catch 22 in the sense opposite to the one as indicated by arrow c against the resilient force of the spring 24 to the position as indicated by the solid line in FIG. 4, where it is interlocked with the clutch 28, which will be described later, and, at the same time, the sliding rail 7 and the traveler device 9 are coupled through the engagement of said radial extension 27 of the recess 25 and the pin 7b.

The lid 9b is provided with a notch 29 at its front edge and on the path of said radial extension 27 of the recess 25 of the catch 22 in order to allow the pin 7b to be released from the radial extension 27 of the recess 25.

As illustrated in FIG. 6, the main body 9a and the lid 9b of the traveler device 9 are respectively provided at the lower ends with ridges 9c, 9c to be respectively engaged with grooves 30, 30 longitudinally and horizontally arranged on the lateral sides of said auxiliary fixed rail 3a so that the traveler device 9 may be longitudinally slidable along and securely held by said auxiliary fixed rail 3a.

Said clutch 28 has a configuration as described below.

As seen from FIGS. 4 and 6, the main body 9a of the traveler device 9 is provided with a vertical through bore 28b at its front bottom 9d and at a position where it comes vis-a-vis the corresponding bore 28a arranged on the arc-shaped bottom of the catch 22 when the catch 22 is located at the position indicated by the solid line in FIG. 4 in order to contain a ball latch 28c, which is revolvable in the moving direction of the traveler device 9 and freely movable in the vertical direction.

The upper surface 3b of said auxiliary fixed rail 3a is provided with a round dent 28d for removably receiving said ball latch 28c at a position where said traveler device 9 terminates its motion when the drawer 2a is pulled away from the compartment 1b.

Note that both the bore 28a and the dent 28d have a depth which is smaller than one half the diameter of the ball latch 28c or approximately one third of its diameter.

The clutch 28, as described above, operates in the following way.

Normally, the ball latch 28c is pushed up by the upper surface 3b of the auxiliary fixed rail 3a so that its upper portion is received by the bore 28a of the catch 22 and therefore the catch 22 is maintained to a state where it is engaged with the pin 7b of the sliding rail 7. Under this condition, the traveler device 9 can freely slide along the auxiliary fixed rail 7a.

When the traveler device 9 is pulled with the drawer 2a away from the compartment lb against said pulling force, it moves until said ball latch 28c is received by the round dent 28d of the auxiliary fixed rail 3a, where said catch 22 is driven to pivot forward as the force pulling the drawer 2a is applied to it by way of the sliding rail 7 and the pin 7b so that the ball latch 28c is pushed downward by the arc-shaped bottom 22a of the catch 22 and released from the bore 28a. Then, lower portion of the ball latch 28c is received by the round dent 28d for engagement therewith, while the catch 22 is rotated forward by a given angle until it reaches the position as indicated by the broken line in FIG. 4 to release the pin 7b so that the traveler device 9 is held to the given displaced position against the force pulling the drawer 2a as the ball latch 28c is constantly pushed downward by the bottom 22a of the catch. Under this condition, the drawer 2a can be completely moved away from the cabinet main body 1a.

When, on the other hand, the drawer is put back in the cabinet main body 1a by bringing the sliding rail 7 into engagement with the fixed rail 3 until it is completely housed by the compartment lb, the pin 7b of the sliding rail 7 eventually comes to be engaged with the radial extension 27 of the recess 25 so that the catch 22 is rotated backward by the inertia of the drawer 2a by a given angle against the resilient force of the spring. Under this state, the inertia of the drawer 2a is imparted to the traveler device 9 by way of said catch 22 and therefore the ball latch 28c is pushed up and released from the round dent 28d of the auxiliary fixed rail 3a to be received by the bore 28a of the catch 22 at the upper portion. Now, the traveler device 9 is released from the anchored condition and pulled backward by the spring means 20 along the auxiliary fixed rail 3a so that the drawer 2a is automatically moved back into and completely housed by the compartment 1b.

It should be noted that said spring means 20 is not necessarily be a constant load spring and a simple coil spring may be alternatively used.

As is apparent from the above detailed description of the present invention, when the movable member is pulled away from the fixed member, the sliding rail and the traveler device of the movable member are moved in the same direction with said movable member along the fixed rail against the pulling force of the spring means for a give stroke until the catch is rotated by the inertia of the movable member by a given angle to switch the operation of the clutch means and stop the traveler device. At the same time, the engagement between the sliding rail and the traveler device is released so that the movable member can thereafter freely move in either direction. Likewise since the engagement between the fixed rail and the sliding rail is released so that the movable member can be completely separated from the fixed member. When, on the other hand, the sliding rail is put back for engagement with the fixed rail and the movable member is moved in the other direction, the sliding rail pushes up the catch and rotate it by a given angle so that the sliding rail and the traveler device are coupled together while the operation of the clutch is switched to release the traveler device from the anchored condition. Then, the movable member and the traveler device can be moved in said other direction without effort. Since no special operation is required for removing and restoring the movable member, it can be handled very easily at all events.

Moreover, by appropriately selecting the position for holding the traveler device by means of the clutch, the free running range and the automatic running range of the movable member can be conveniently determined.

What is claimed is:

1. A mechanism for controlling the travel of a movable structural member along rails, said mechanism comprising a fixed member provided with a pair of fixed rails, a pair of sliding rails guidingly engaged with the respective fixed rails and a movable member arranged on said sliding rails, a pair of traveler devices connected to said sliding rails and engaged with the respective fixed rails for movement therealong, a pair of spring means connected between said fixed member and said traveler devices for pulling the respective traveler devices in a given direction along said fixed rails, a pair of catch means including first and second operational moves and operatively associated with said traveler devices, fixed rails and said movable member operative, when in said first operational mode, to prevent movement of said movable member in the opposite direction relative to said traveler means, and further operative to shift to said second operational mode upon movement of said traveler devices in said opposite direction relative to said fixed rails to predetermined positions in said opposite direction and release said movable member for movement thereof relative to said traveler devices in said opposite direction and also operative, upon subsequent movement of said movable member in said given direction relative to said traveler devices to shift to said first operational mode to lock said movable member to said traveler devices for movement therewith in said given direction and release said traveler devices from said fixed rails for movement therealong under the biasing action of said spring means in said given direction.

2. The mechanism of claim 1 wherein said catch means includes a selectively releasable and engagable position detect connection with said fixed rails, said detent connection being in the engaged position when said catch means is in said first operational mode and in the release position when said catch means is in said second operational mode.

3. A mechanism for controlling the travel of a movable structural member, said mechanism comprising a fixed member provided with fixed elongated guide means, movable guide means guidingly engaged with said fixed guide means and a movable member arranged on said movable guide means, traveler means connected to said movable guide means and engaged with said fixed elongated guide means for movement therealong, spring means connected between said fixed member and said traveler means for pulling said traveler means in a given direction along said fixed elongated guide means, catch means including first and second operational modes and operatively associated with said traveler means, fixed elongated guide means and said movable member and operative, when in said first operational mode, to prevent movement of said movable member in the opposite direction relative to said traveler means, and further operative to shift to said second operational mode upon movement of said traveler means relative to said fixed elongated guide means to predetermined positions in said opposite directions and release said movable member for movement thereof relative to said traveler means in said opposite direction and also operative, upon subsequent movement of said movable member in said given direction relative to said traveler means to shift to said first operational mode to lock said movable member to said traveler means for movement therewith in said given direction and release said traveler means for said fixed elongated guide means for movement therealong under the biasing action of said spring means.

* * * * *